US005823236A

United States Patent [19]

Kirby et al.

[11] Patent Number: 5,823,236

[45] Date of Patent: Oct. 20, 1998

[54] AEROSOL CAN PUNCTURING MACHINE

[75] Inventors: James E. Kirby, Norwalk; Glen Silva Abad, La Habra; Ralph E. Jaffke, Lakewood, all of Calif.

[73] Assignee: Northrop Grumman Corporation, Los Angeles, Calif.

[21] Appl. No.: 917,999

[22] Filed: Aug. 25, 1997

[51] Int. Cl.[6] ..... B67B 7/00

[52] U.S. Cl. ..... 141/330; 141/329; 141/51; 141/97; 141/98; 222/87

[58] Field of Search ..... 141/329, 330, 141/97, 98, 51, 65; 222/87

[56] References Cited

U.S. PATENT DOCUMENTS

| | | | |
|---|---|---|---|
| 3,333,735 | 8/1967 | Odasso | 222/5 |
| 3,438,548 | 4/1969 | Ceyba | 222/80 |
| 3,828,976 | 8/1974 | Sidelinker | 222/83.5 |
| 4,349,054 | 9/1982 | Chipman et al. | 141/1 |
| 4,407,341 | 10/1983 | Feldt et al. | 141/97 |
| 4,459,906 | 7/1984 | Cound et al. | 100/45 |
| 4,526,097 | 7/1985 | Cound | 100/215 |
| 5,114,043 | 5/1992 | Collins, Jr. | 222/86 |
| 5,181,462 | 1/1993 | Isaac | 100/98 |
| 5,265,762 | 11/1993 | Campbell et al. | 222/5 |
| 5,271,437 | 12/1993 | O'Brien et al. | 141/51 |
| 5,309,956 | 5/1994 | Hajma | 141/7 |
| 5,322,093 | 6/1994 | O'Neil | 141/51 |
| 5,365,982 | 11/1994 | O'Neill | 141/51 |
| 5,385,177 | 1/1995 | O'Neil | 141/1 |

*Primary Examiner*—J. Casimer Jacyna
*Assistant Examiner*—Kerry S. Culpepper
*Attorney, Agent, or Firm*—Terry J. Anderson; Karl J. Hoch, Jr.

[57] ABSTRACT

An aerosol can puncturing machine comprising a lower housing section which is adapted to receive at least a portion of an aerosol can, and an upper housing section which is removably attachable to the lower housing section. The upper and lower housing sections fully encase the aerosol can when attached to each other. Connected to the lower housing section is a locking mechanism which is movable between an unlocked position wherein the upper housing section is detachable from the lower housing section, and a locked position wherein the upper housing section is maintained in locked engagement to the lower housing section. Also connected to the lower housing section is a puncturing mechanism which is operable to selectively puncture the aerosol can encased within the attached upper and lower housing sections.

13 Claims, 2 Drawing Sheets

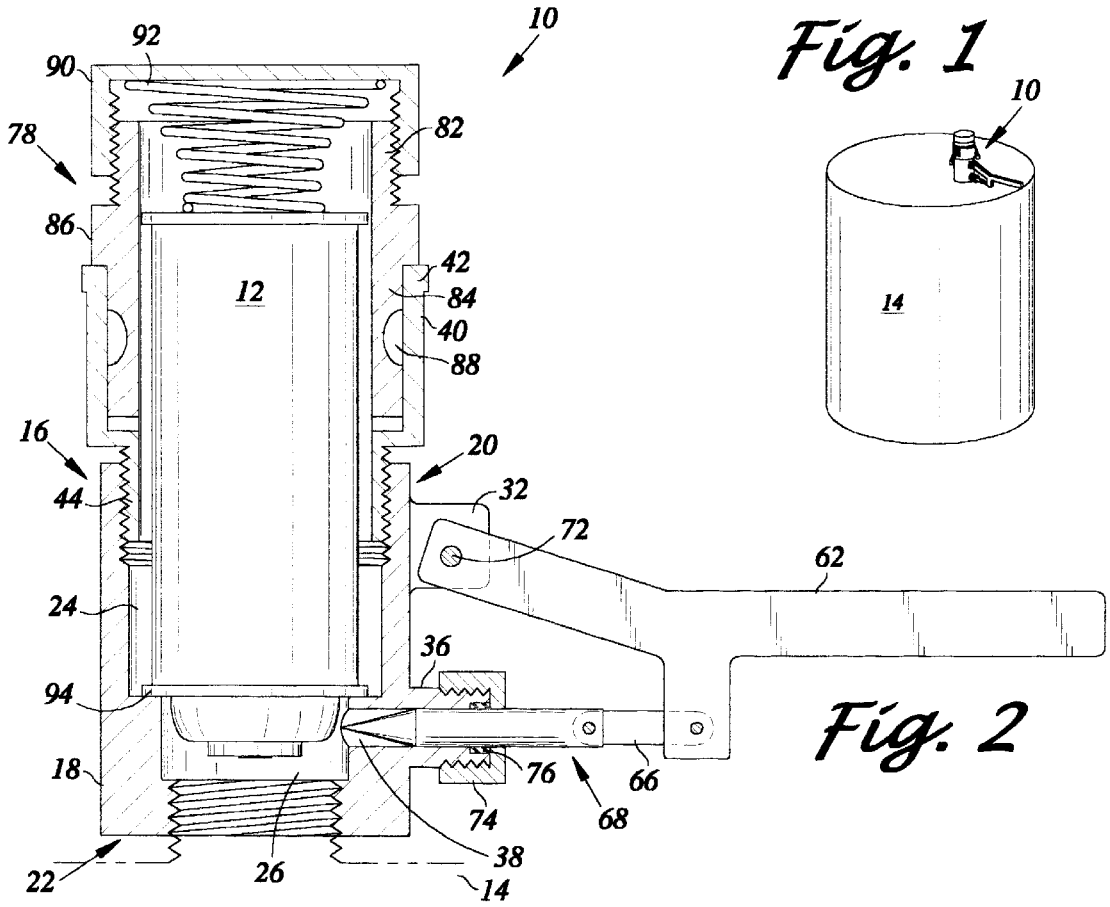
Fig. 1
Fig. 2
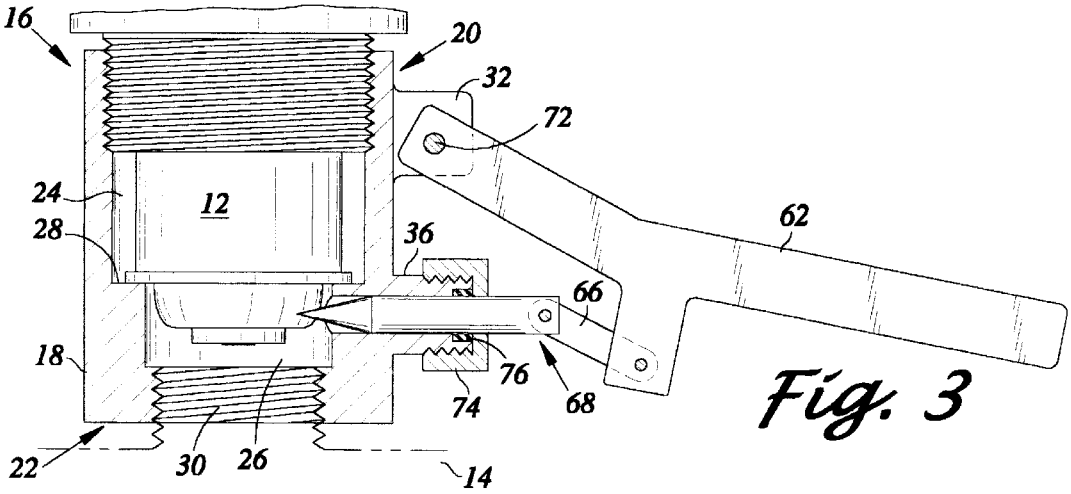
Fig. 3

AEROSOL CAN PUNCTURING MACHINE

FIELD OF THE INVENTION

The present invention relates generally to hazardous waste disposal devices, and more particularly to a fully enclosed aerosol can puncturing machine which is specifically designed to prohibit the aerosol can from emitting hazardous fluids into the atmosphere during the puncturing process.

BACKGROUND OF THE INVENTION

The disposal of aerosol cans presents certain problems which are not encountered with the disposal of other types of products. In this respect, though the disposal of many types of products is accomplished through the use of incinerators, this particular disposal process is extremely undesirable for aerosol cans due to the combustible nature of the contents thereof and the resultant explosion that normally occurs when the aerosol cans are heated. Accordingly, when disposing of aerosol cans, it is desirable to puncture the same for purposes of releasing any remaining pressurized contents thereof. However, the puncturing process itself gives rise to certain problems in that many of the fluids (i.e., liquids and/or gases) emitted from the punctured aerosol can are hazardous, thus necessitating that steps be taken to prohibit such fluids from being openly released into the atmosphere.

The present invention addresses the various problems associated with the disposal of aerosol cans by providing a fully enclosed aerosol can puncturing machine which is specifically adapted to prohibit the aerosol can from emitting hazardous fluids into the atmosphere during the puncturing process. The puncturing machine constructed in accordance with the present invention is designed so as to allow an aerosol can to be quickly and easily inserted thereinto and removed therefrom, and to cause the contents of the punctured aerosol can to be released into a containment vessel such as a 55 gallon drum either directly or through a series of filters.

SUMMARY OF THE INVENTION

In accordance with the present invention, there is provided an aerosol can puncturing machine which comprises a lower housing section adapted to receive at least a portion of an aerosol can. The lower housing section itself comprises a base member having a coupling member which is threadably connected thereto. The puncturing machine further comprises an upper housing section which is removably attachable to the lower housing section. The upper housing section itself comprises an adaptor member which is partially insertable into the coupling member, and a cap member which is threadably connected to the adaptor member. The upper and lower housing sections fully encase the aerosol can when attached to each other via the insertion of the adaptor member into the coupling member.

In addition to the lower and upper housing sections, the puncturing machine of the present invention comprises a locking mechanism which is connected to the lower housing section. The locking mechanism is movable between an unlocked position wherein the upper housing section is detachable from the lower housing section via the removal of the adaptor member from within the coupling member, and a locked position wherein the upper housing section is maintained in locked engagement to the lower housing section. The locking mechanism preferably includes a pair of cam levers which are pivotally connected to the coupling member of the lower housing section in opposed relation to each other. The movement of the cam levers to their locked positions facilitates the engagement thereof to the adaptor member of the upper housing section in a manner preventing the detachment of the upper housing section from the lower housing section.

The puncturing machine of the present invention further comprises a puncturing mechanism which is connected to the lower housing section and is operable to selectively puncture the aerosol can encased within the upper and lower housing sections. The puncturing mechanism includes a lever handle which is pivotally connected to the base member of the lower housing section and movable between first and second positions. Slidably engaged to the base member of the lower housing section is a piercing pin which is reciprocally movable relative thereto. Additionally, pivotally connected to and extending between the lever handle and the piercing pin is a link member. The movement of the lever handle to its second position facilitates the advancement of the piercing pin into the aerosol can. Conversely, the movement of the lever handle back to its first position facilitates the withdrawal of the piercing pin from within the aerosol can. The puncturing mechanism further includes a sealing gasket which circumvents the piercing pin for preventing the escape of fluids from within the attached upper and lower housing sections during the aerosol can puncturing process.

The puncturing machine of the present invention is further provided with a biasing mechanism for biasing the aerosol can toward the lower housing section when the upper housing section is attached thereto. The biasing mechanism preferably comprises a spring having a first end which is attached to the cap member of the upper housing section and a second end which is abutted against the aerosol can when the adaptor member is inserted into the coupling member. The spring is compressed between the cap member and the aerosol can when the upper housing section is attached to the lower housing section.

BRIEF DESCRIPTION OF THE DRAWINGS

These, as well as other features of the present invention, will become more apparent upon reference to the drawings wherein:

FIG. 1 is a perspective view of an aerosol can puncturing machine constructed in accordance with the present invention as attached to a containment vessel;

FIG. 2 is a cross-sectional view of the aerosol can puncturing machine of the present invention, illustrating the puncturing mechanism thereof in a first position withdrawn from an aerosol can;

FIG. 3 is a partial cross-sectional view of the lower half of the aerosol can puncturing machine of the present invention, illustrating the puncturing mechanism thereof in a second position puncturing an aerosol can;

DETAILED DESCRIPTION OF THE PREFERRED EMBODIMENT

Figure 4:
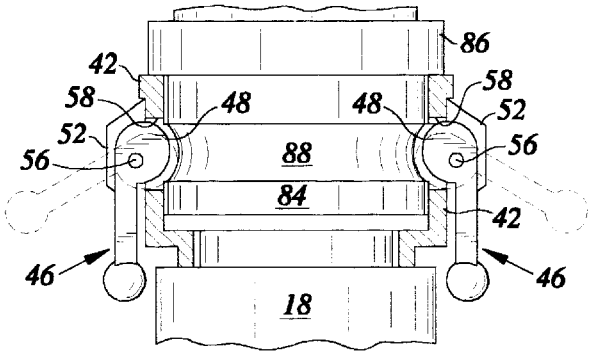
FIG. 4 is a partial cross-sectional view illustrating the movement of a locking mechanism of the aerosol can puncturing machine of the present invention between its locked and unlocked positions.

Referring now to the drawings wherein the showings are for purposes of illustrating a preferred embodiment of the present invention only, and not for purposes of limiting the same, FIGS. 1–5 illustrate an aerosol can puncturing machine 10 which is constructed in accordance with the present invention. As will be described in more detail below, the puncturing machine 10 is designed to puncture an aerosol can 12 which is quickly and easily insertable into and removable from within the puncturing machine 10. The puncturing machine 10 is preferably adapted to be fluidly coupled to a containment vessel 14 such as a 55 gallon drum as shown in FIG. 1 for allowing the contents of the punctured aerosol can 12 (e.g., liquids, gases, propellants, etc.) to be released into the containment vessel 14 rather than into the open atmosphere. The aerosol can contents can be released into the containment vessel 14 either directly or through a series of filters (not shown) such as fiber/carbon activated filters. Advantageously, during the puncturing process, the aerosol can 12 is fully enclosed within the puncturing machine 10, thus preventing any undesirable emission of potentially hazardous fluids into the atmosphere.

Figure 5:
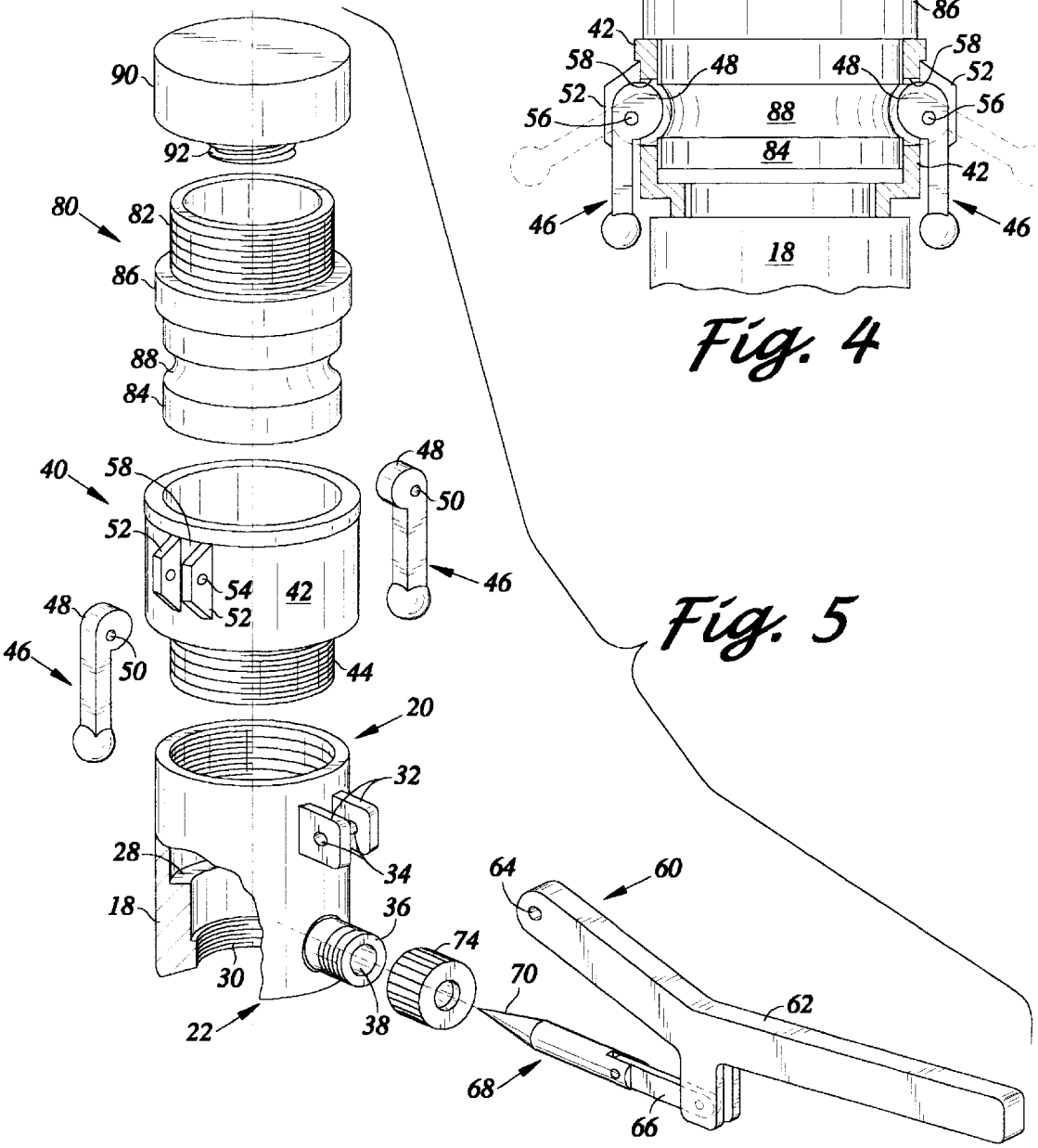
FIG. 5 is an exploded view of the aerosol can puncturing machine of the present invention.

As seen in FIGS. 2, 3 and 5, the puncturing machine 10 of the present invention comprises a lower housing section 16 which is adapted to receive at least a portion of the aerosol can 12. The lower housing section 16 itself comprises a tubular, cylindrically configured base member 18. The base member 18 is preferably fabricated from a metal material, and includes a top end 20 and a bottom end 22. The interior of the base member 18 is not of constant diameter, but rather includes an upper section 24 and a reduced diameter lower section 26, with the upper and lower sections 24, 26 being separated by an annular shoulder 28. A portion of the base member 18 adjacent the top end 20 and defining the upper section 24 is internally threaded. Additionally, disposed within the bottom end 22 of the base member 18 is an internally threaded bore 30 which communicates with the lower section 26. As seen in FIGS. 1–3, the bore 30 is used to facilitate the threadable engagement of the base member 18, and hence the puncturing machine 10, to a complementary, externally threaded fitting extending from the containment vessel 14.

The base member 18 of the lower housing section 16 further includes an opposed pair of ear portions 32 which extend outwardly from the outer surface thereof in relative close proximity to the top end 20. The ear portions 32 extend in spaced, generally parallel relation to each other, and include a pair of coaxially aligned apertures 34 disposed therein. Also extending outwardly from the outer surface of the base member 18 underneath the ear portions 32 and in relative close proximity to the bottom end 22 is an externally threaded boss 36. Extending axially through the boss 36 is a passage 38 which communicates with the lower section 26 of the interior of the base member 18.

In addition to the base member 18, the lower housing section 16 of the puncturing machine 10 includes a tubular, generally cylindrical coupling member 40. The coupling member 40 is also preferably fabricated from a metal material, and includes a top section 42 and a reduced diameter, externally threaded bottom section 44. The bottom section 44 is complementary to the internally threaded portion of the base member 18 adjacent its top end 20, with the threadable connection of the bottom section 44 thereto facilitating the rigid attachment of the coupling member 40 to the base member 18 as shown in FIGS. 2 and 3.

Referring now to FIGS. 4 and 5, the coupling member 40 of the lower housing section 16 is provided with a locking mechanism. The locking mechanism comprises a pair of cam levers 46 which are pivotally connected to the top section 42 of the coupling member 40 in opposed relation to each other. Each of the cam levers 46 includes an upper end which defines a camming surface 48 and has an aperture 50 extending laterally therethrough. The pivotal connection of each of the cam levers 46 to the coupling member 40 is facilitated by the placement of the upper end thereof between a respective pair of ear portions 52 which extend outwardly from the outer surface of the top section 42 in spaced, generally parallel relation to each other, and include a coaxially aligned pair of apertures 54 disposed therein. In this respect, the upper end of the cam lever 46 is placed between the ear portions 52 of a respective pair such that the aperture 50 thereof is coaxially aligned with the apertures 54. Thereafter, a fastener 56 such as a pivot pin is extended through the coaxially aligned apertures 50, 54, thus pivotally connecting the cam lever 46 to the coupling member 40. As further seen in FIGS. 4 and 5, disposed within the top section 42 between each pair of ear portions 52 is an opening 58 which communicates with the interior of the coupling member 40. The openings 58 accommodate portions of the upper ends of respective ones of the cam levers 46.

In the puncturing machine 10, the cam levers 46 of the locking mechanism are movable between an unlocked position (shown in solid lines in FIG. 4) and a locked position (shown in phantom in FIG. 4). When the cam levers 46 are in their locked positions, the camming surfaces 48 of the upper ends thereof reside substantially within respective ones of the openings 58. The upward rotation of the cam levers 46 facilitates the movement thereof to their locked positions, which causes the camming surfaces 48 of the upper ends thereof to protrude inwardly into the interior of the top section 42 of the coupling member 40 a distance greater than when the cam levers 46 are in their unlocked positions. The use of the locking mechanism, and more particularly the cam levers 46, will be described in more detail below.

Referring now to FIGS. 2, 3 and 5, in addition to the previously described locking mechanism, also connected to the lower housing section 16, and in particular the base member 18 thereof, is a puncturing mechanism 60. The puncturing mechanism 60 comprises a lever handle 62 which includes an upwardly sloped frontal portion. Extending laterally through the frontal portion of the lever handle 62 in relative close proximity to the distal end thereof is an aperture 64. Additionally, extending downwardly from the lever handle 62 between the frontal and rear portions thereof is a mounting portion which includes one end of a link member 66 pivotally connected thereto. Pivotally connected to the opposite end of the link member 66 is the back end of a piercing pin 68, the front end of which defines a sharply pointing piercing tip 70.

In the puncturing machine 10, the lever handle 62 of the puncturing mechanism 60 is pivotally connected to the base member 18 of the lower housing section 16. Such pivotal connection is facilitated by the placement of the distal end of the frontal section of the lever handle 62 between the ear portions 32 of the base member 18 such that the aperture 64 is coaxially aligned with the apertures 34. Thereafter, a fastener 72 such as a pivot pin is extended through the coaxially aligned apertures 34, 64. In addition to the lever handle 62 being pivotally connected to the base member 18, the piercing pin 68 is extended into the passage 38 defined by the boss 36 extending outwardly from the base member 18. Prior to being extended into the passage 38, the piercing pin 68 is advanced through the opening of an internally threaded sealing cap 74 which is threadably connected to the boss 36. Compressed between the sealing cap 74 and a shoulder defined by the boss 36 is a sealing gasket 76 which circumvents the cylindrically configured body of the piercing pin 68. The sealing cap 74 maintains compressive pressure on the sealing gasket 76 which causes the same to form a fluid-tight seal about the piercing pin 68.

As seen in FIGS. 2 and 3, the puncturing mechanism 60 is movable between a first position (shown in FIG. 2) wherein the piercing tip 70 of the piercing pin 68 resides within the passage 38 extending through the boss 36 and communicating with the lower section 26 of the interior of the base member 18. The clockwise rotation of the lever handle 62 facilitates the movement of the puncturing mechanism 60 to a second position (shown in FIG. 3) wherein the piercing tip 70 of the piercing pin 68 protrudes from the passage 38 into the lower section 26 of the interior of the base member 18. The diameter of the passage 38 exceeds that of the piercing pin 68, thus allowing the piercing pin 68 to be slidably movable therein upon the rotation of the lever handle 62. Importantly, the seal created by the sealing gasket 76 against the piercing pin 68 is maintained as the puncturing mechanism 60, and in particular the piercing pin 68, is reciprocally moved between the first and second positions. The use of the puncturing mechanism 60 will also be described in more detail below.

Referring now to FIGS. 2, 4 and 5, in addition to the lower housing section 16, the puncturing machine 10 of the present invention includes an upper housing section 78 which is removably attachable to the lower housing section 16. The upper housing section 78 itself comprises a tubular adaptor member 80. The adaptor member 80 is preferably fabricated from a metal material, and includes an externally threaded upper section 82 which defines the top end thereof, and a generally cylindrical lower section 84 which defines the bottom end thereof. The upper and lower sections 82, 84 are separated by a middle section 86 which extends radially outward relative thereto. Formed within and extending about the outer surface of the lower section 84 is a continuous channel 88 which has an arcuately contoured configuration. The outer diameter of the lower section 84 is sized relative to the inner diameter of the top section 42 of the coupling member 40 such that the lower section 84 is slidably insertable into the top section 42. As seen in FIGS. 2 and 4, the advancement of the lower section 84 of the adaptor member 80 into the top section 42 of the coupling member 40 is limited by the abutment of the middle section 86 against the top end of the coupling member 40 defined by the top section 42 thereof. When the middle section 86 is abutted against the top section 42, the lower section 84 of the adaptor member 80 extends to approximately the bottom section 44 of the coupling member 40.

In addition to the adaptor member 80, the upper housing section 78 comprises an internally threaded end cap 90 which is threadably engagable to the complementary, externally threaded upper section 82 of the adaptor member 80. The end cap 90 is also preferably fabricated from a metal material. Attached to the inner surface of the end cap 90 is a coil spring 92 which protrudes beyond the internally threaded wall thereof. In this respect, as seen in FIG. 2, when the end cap 90 is threadably engaged to the upper section 82 of the adaptor member 80, the distal end of the coil spring 92 extends within the interior of the adaptor member 80 to approximately the middle section 86 thereof.

The puncturing machine 10 of the present invention is used by initially attaching the same to the containment vessel 14. As previously indicated, such attachment is facilitated by the receipt of the externally threaded fitting of the containment vessel 14 into the complementary, internally threaded bore 30 of the base member 18 of the lower housing section 16. However, though not shown, the bore 30 may also be used to threadably engage the puncturing machine 10 to one end of a hose or other tubular connection which may be used to interface the puncturing machine 10 to any type of containment vessel.

Subsequent to the fluid connection of the puncturing machine 10 to the containment vessel 14, the upper housing section 78 (comprising the adaptor member 80 and end cap 90) is detached from the lower housing section 16 (comprising the base member 18 and coupling member 40). Such detachment is facilitated by removing the lower section 84 of the adaptor member 80 from within the top section 42 of the coupling member 40. Subsequent to such detachment, the aerosol can 12 is inserted into the lower housing section 16 upside down such that the upper rim 94 of the aerosol can 12 disposed between the body and reduced diameter neck portions thereof is abutted against the shoulder 28 separating the upper and lower sections 24, 26 of the interior of the base member 18 from each other. When the upper rim 94 is abutted against the shoulder 28, the neck portion of the aerosol can 12 extends into the lower section 26 of the interior of the base member 18 in front of the passage 38 communicating therewith. When the aerosol can 12 is placed within the lower housing section 16 in this manner, the lower end of the aerosol can 12 protrudes slightly beyond the top end of the coupling member 40 defined by the top section 42 thereof. When the aerosol can 12 is initially placed into the lower housing section 16, the puncturing mechanism 60 is in its first position as shown in FIG. 2, with the locking mechanism, and in particular the cam levers 46, being in their unlocked positions as shown in FIG. 4.

Subsequent to the placement of the aerosol can 12 into the lower housing section 16 in the aforementioned manner, the upper housing section 78 is attached to the lower housing section 16. Such attachment is facilitated by the advancement of the lower section 84 of the adaptor member 80 over the aerosol can 12 and into the interior of the top section 42 of the coupling member 40 until such time as the middle section 86 is abutted thereagainst. As best seen in FIG. 2, there is sufficient clearance between the outer surface of the aerosol can 12 and the inner surface of the top section 42 of the coupling member 40 to accommodate the receipt of the lower section 84 of the adaptor member 80. Importantly, forcing the middle section 86 into contact with the top section 42 results in the abutment of the coil spring 92 against the lower end of the aerosol can 12, and the compression thereof between the aerosol can 12 and the end cap 90. This compression of the coil spring 92 causes the same to exert a downward biasing force against the aerosol can 12 which results in the upper rim 94 thereof being firmly abutted against the shoulder 28 of the base member 18.

While downward pressure is being applied to the end cap 90 to maintain the middle section 86 of the adaptor member 80 in contact with the top section 42 of the coupling member 40, the cam levers 46 of the locking mechanism are rotated from their unlocked to their locked positions. As previously explained, the movement of the cam levers 46 to their locked positions is facilitated by the upward rotation thereof. As seen in FIG. 4, such upward rotation causes the camming surfaces 48 of the cam levers 46 to tightly engage the arcuately contoured surface portion of the lower section 84 of the adaptor member 80 which defines the channel 88 thereof. As will be recognized, for the abutment of the camming surfaces 48 against the arcuate surface defining the channel 88 to occur, the lower section 84 of the adaptor member 80 is sized relative to the top section 42 of the coupling member 40 such that the openings 58 within the top section 42 are aligned with the channel 88 when the middle section 86 of the adaptor member 80 is abutted against the top section 42 of the coupling member 40. When the cam levers 46 are moved to their locked positions in the aforementioned manner, the upper housing section 78 is effectively maintained in locked engagement to the lower housing section 16, with the aerosol can 12 being fully encased within the attached lower and upper housing sections 16, 78 and biased against the shoulder 28 by the coil spring 92.

After the upper housing section 78 has been locked to the lower housing section 16 in the aforementioned manner to fully encase the aerosol can 12, the puncturing mechanism 60, and in particular the piercing pin 68 thereof, is actuated from its first position (shown in FIG. 2) to its second position (shown in FIG. 3). In this respect, the clockwise rotation of the lever handle 62 slidably advances the piercing pin 68 through the passage 38 toward the aerosol can 12 such that the piercing tip 70 thereof punctures or pierces the neck portion of the aerosol can 12. Subsequent to such puncturing, the lever handle 62 is rotated in a counterclockwise direction to return the puncturing mechanism 60 to its first position which results in the withdrawal of the piercing tip 70 of the piercing pin 68 from within the neck portion of the aerosol can 12. Such withdrawal allows the contents of the aerosol can 12 to escape from therewithin and travel downwardly into the containment vessel 14 via the externally threaded fitting or other coupling which is received into the bore 30 of the base member 18.

The locked engagement of the upper housing section 78 to the lower housing section 16 prevents any accidental detachment of the upper housing section 78 from the lower housing section 16 attributable to the sudden release of pressure from the aerosol can 12 when the neck portion thereof is punctured by the puncturing mechanism 60. Importantly, fluids emitted from the punctured aerosol can 12 are prevented from flowing upwardly beyond the upper rim 94 of the aerosol can 12 due to the tight engagement thereof to the shoulder 28 as is achieved by the biasing force exerted against the aerosol can 12 by the coil spring 92. Additionally, fluids are prevented from escaping the puncturing machine 10 between the piercing pin 68 and the wall defining the passage 38 by the seal created by the sealing gasket 76. Though not shown, it will be recognized that the shoulder 28 of the base member 18 may be provided with a sealing member for enhancing the fluid-tight seal created against the upper rim 94 of the aerosol can 12 biased thereagainst.

After the contents of the aerosol can 12 have been channeled into the containment vessel 14, the cam levers 46 are returned to their unlocked positions, thus allowing for the detachment of the upper housing section 78 from the lower housing section 16. As previously explained, such detachment is facilitated by the removal of the lower section 84 of the adaptor member 80 from within the top section 42 of the coupling member 40. Subsequent to such detachment, the aerosol can 12 is simply removed from within the lower housing section 16 and discarded. As will be recognized, it is contemplated that certain devices will be provided within the containment vessel 14 or between the containment vessel 14 and the puncturing machine 10 to prevent the back-flow of fluids from the containment vessel 14 through the puncturing machine 10 when the upper housing section 78 is detached from the lower housing section 16 and the aerosol can 12 is removed from therewithin.

Additional modifications and improvements of the present invention may also be apparent to those of ordinary skill in the art. Thus, the particular combination of parts described and illustrated herein is intended to represent only one embodiment of the present invention, and is not intended to serve as limitations of alternative devices within the spirit and scope of the invention.

What is claimed is:

1. An aerosol can puncturing machine comprising:

a lower housing section adapted to receive at least a portion of an aerosol can;

an upper housing section removably attachable to said lower housing section, said upper and lower housing sections fully encasing the aerosol can when attached to each other;

a locking mechanism connected to the lower housing section and movable between an unlocked position wherein the upper housing section is detachable from the lower housing section and a locked position wherein the upper housing section is maintained in locked engagement to the lower housing section;

wherein said locking mechanism comprises:

at least one cam lever pivotally connected to the lower housing section;

the movement of the cam lever to the locked position facilitating the engagement thereof to the upper housing section in a manner preventing the detachment of the upper housing section from the lower housing section; and a puncturing mechanism connected to the lower housing section and operable to selectively puncture the aerosol can encased within the upper and lower housing sections.

2. The puncturing machine of claim 1 wherein the locking mechanism comprises a pair of cam levers pivotally connected to the lower housing section in opposed relation to each other.

3. The puncturing machine of claim 1 wherein the puncturing mechanism comprises:

a lever handle pivotally connected to the lower housing section and movable between first and second positions;

a piercing pin slidably engaged to the lower housing section and reciprocally movable relative thereto; and a link member pivotally connected to and extending between the lever handle and the piercing pin;

the movement of the lever handle to the second position facilitating the advancement of the piercing pin into the aerosol can, with the movement of the lever handle to the first position facilitating the withdrawal of the piercing pin from within the aerosol can.

4. The puncturing machine of claim 3 wherein the puncturing mechanism further comprises a sealing gasket circumventing the piercing pin for preventing the escape of fluids from within the attached upper and lower housing sections.

5. The puncturing machine of claim 1 wherein the upper housing section includes a biasing mechanism for biasing the aerosol can toward the lower housing section when the upper housing section is attached thereto.

6. The puncturing machine of claim 6 wherein the biasing mechanism comprises a spring having a first end attached to the upper housing section and a second end which is abutted against the aerosol can when the upper housing section is attached to the lower housing section, said spring being compressed between the upper housing section and the aerosol can when the upper housing section is attached to the lower housing section.

7. An aerosol can puncturing machine comprising:

a lower housing section adapted to receive at least a portion of an aerosol can and comprising:

a base member; and a coupling member attached to the base member;

an upper housing section removably attachable to said lower housing section and comprising:

an adaptor member partially insertable into the coupling member; and a cap member attached to said adaptor member;

said upper and lower housing sections fully encasing said aerosol can when attached to each other via the insertion of the adaptor member into the coupling member;

a locking mechanism connected to the coupling member and movable between an unlocked position wherein the upper housing section is detachable from the lower housing section via the removal of the adaptor member from within the coupling member, and a locked position wherein the upper housing section is maintained in locked engagement to the lower housing section; and a puncturing mechanism connected to the base member and operable to selectively puncture the aerosol can encased within the upper and lower housing sections.

8. The puncturing mechanism of claim 7 wherein said locking mechanism comprises:

at least one cam lever pivotally connected to the coupling member;

the movement of the cam lever to the locked position facilitating the engagement thereof to the adaptor member in a manner preventing the removal of the adaptor member from within the coupling member.

9. The puncturing mechanism of claim 8 wherein the locking mechanism comprises a pair of cam levers pivotally connected to the coupling member in opposed relation to each other.

10. The puncturing machine of claim 7 wherein the puncturing mechanism comprises:

a lever handle pivotally connected to the base member and movable between first and second positions;

a piercing pin slidably engaged to the base member and reciprocally movable relative thereto; and a link member pivotally connected to and extending between the lever handle and the piercing pin;

the movement of the lever handle to the second position facilitating the advancement of the piercing pin into the aerosol can, with the movement of the lever handle to the first position facilitating the withdrawal of the piercing pin from within the aerosol can.

11. The puncturing machine of claim 10 wherein the puncturing mechanism further comprises a sealing gasket circumventing the piercing pin for preventing the escape of fluids from within the attached upper and lower housing sections.

12. The puncturing machine of claim 7 wherein the upper housing section includes a biasing mechanism for biasing the aerosol can toward the lower housing section when the upper housing section is attached thereto.

13. The puncturing machine of claim 12 wherein the biasing mechanism comprises a spring having a first end attached to the cap member and a second end which is abutted against the aerosol can when the adaptor member is inserted into the coupling member, said spring being compressed between the cap member and the aerosol can when the upper housing section is attached to the lower housing section.

* * * * *